United States Patent [19]

Walker et al.

[11] 4,067,281

[45] Jan. 10, 1978

[54] SAFETY RELEASE BITT

[76] Inventors: Arnold V. Walker, Rte. 1, Box 1144, Pascagoula, Miss. 39567; Harris H. Rose, Sr., 2117 Guardian St., Gretna, La. 70053

[21] Appl. No.: 799,358

[22] Filed: May 23, 1977

[51] Int. Cl.[2] ..... B63B 59/02

[52] U.S. Cl. ..... 114/219; 61/48

[58] Field of Search ..... 114/218, 230, 247, 248, 114/251-253; 294/84

[56] References Cited

U.S. PATENT DOCUMENTS

| | | | |
|---|---|---|---|
| 2,990,801 | 7/1961 | Ash | 114/218 |
| 3,973,511 | 8/1976 | Balston | 114/218 |

*Primary Examiner*—Stephen G. Kunin
*Assistant Examiner*—Jesus D. Sotelo
*Attorney, Agent or Firm*—Mason, Fenwick & Lawrence

[57] ABSTRACT

A safety release bitt is pivotally mounted on a fixedly positioned bitt base for pivotal movement about a horizontal axis between a vertical position and a horizontal position; a cross pin is mounted on a pivot pin in the upper portion of said bitt for movement between an extended position in which the cross pin extends outwardly of the bitt and a retracted position in which the cross pin is positioned inwardly of the bitt member with a linkage inside the bitt connected to the bitt base serving to automatically move the cross pin from its extended position to its retracted position in response to movement of said bitt from its first position to its second position. A slidable lock bar on the bitt base locks the bitt in its vertical position with a hydraulic cylinder optionally providing for actuation of the lock bar and other optional hydraulic cylinder connected between the bitt and base to pivot the bitt between its horizontal and vertical positions.

14 Claims, 7 Drawing Figures

2
24
62
64
68
28
67
60
74
20
34
71
26
42
41
36
34
50
32
53
40
51
32
22
57
44
32
57
30
2

4
62
64
60
70
67
68
3
66
69
28
57
42
71
72
55
73
36
60
76
3
86
78
54
41
38
44
50
52
57
30
88
4

SAFETY RELEASE BITT

This invention is in the field of bitt devices for providing a mooring connection between a ship, barge or the like and a dock or similar fixed berthing or for providing a towing connection between a tug and a towed or pushed barge, ship or the like. More specifically, the present invention is directed to a unique releasable bitt normally oriented in a vertical manner and over which a towing or mooring cable can be looped and retained in position by means of an outwardly extending cross pin but which can be easily released to pivot to a horizontal position to permit the cable to be immediately disconnected. A significant aspect of the invention resides in the fact that the cross pin is automatically retracted into the body of the bitt in response to movement of the bit from a vertical to a horizontal position. Consequently, the cable can easily slip from the end of the bitt as the bitt moves to a horizontal position so as to completely release the cable.

It is sometimes necessary to quickly release a mooring or towing line either from the vessel or barge being towed or moored or from the dock or the towing vessel. While some prior art devices such as U.S. Pat. No. 3,973,511 have disclosed releasable bollards or the like, such devices have not won widespread acceptance due to a variety of reasons such as excessive cost and difficult and unreliable operation; consequently, the only way in which a taut line can be quickly released in most instances is by cutting with an ax or the like, a somewhat dangerous procedure.

Therefore, it is the primary object of this invention to provide a new and improved releasable bitt.

A more specific object of the invention is the provision of a new and improved releasable bitt capable of releasing a connecting line in an expeditious and trouble-free manner.

Yet another object of the invention is the provision of a new and improved releasable bitt member that is simple in construction and is consequently economical both to fabricate and use.

Achievement of the foregoing objects is enabled by the preferred embodiment of the invention which includes a bitt base formed of structural steel or the like and including a deck plate or panel oriented in a horizontal plane and fastened to a supporting surface. First and second spaced vertical side bracket plates are welded to the upper surface of the deck plate with each of the bracket plates including a pivot shaft opening. A horizontally extending pivot shaft extends through the pivot shaft openings, which are axially aligned, and provides pivotal support for an elongated bitt member. The bitt member is of hollow construction and consists of a generally cylindrical portion which extends above the upper extent of the bracket plates and a lower portion through which the pivot shaft extends. The bitt is of hollow steel construction and a sturdy cross pin is mounted in a cross pin opening in the upper portion of the cylindrical portion of the bitt on a pivot pin extending in a chordal manner adjacent the cross pin opening. The cross pin is capable of movement between an extended position in which it extends outwardly in a radial manner in a horizontal plane with respect to the upper cylindrical portion of the bitt and a retracted position in which it is positioned within the confines and the cylindrical portion. Movement of the cross pin between the extended and the retracted position is enabled by virtue of the fact that the cross pin includes an actuator arm portion formed integrally in the cross pin and extending inwardly toward the center of the cylindrical portion of the bitt. An actuator link means positioned on the interior of the bitt is pivotally connected to the inner end of the cross pin actuator arm and has its lower end pivotally connected to a fixed bracket attached to the deck panel. The geometric relationship of the cross pin actuator arm and the connector link and the bitt member is such that the cross pin is moved to its extended position when the bitt member is pivoted to its vertical position; however, the cross pin is pivoted with respect to the bitt member to its inner recessed position in response to movement of the bitt to its horizontal or released position; consequently, any cable looped over the bitt would consequently be free to slip from the end of the bitt without any interference from the cross pin.

The bitt member also includes a horizontally extending lock plate positioned adjacent to deck panel when the bitt member is in its vertical position. A sliding locking bar is positioned in aligned slots provided in the side bracket plates of the bitt base and is capable of movement into a locking position in which it overlies the lock plate of the bitt member when the bitt member is in its vertical position.

A second embodiment includes hydraulic cylinder means provided for moving the locking bar between a locked and unlocked position to permit the bitt member to pivot from its vertical position to its horizontal or release position. The second embodiment also includes a second hydraulic cylinder connected between the deck plate of the bitt base and the bitt for effecting pivotal movement of the bitt member from its horizontal position to its vertical position.

A better understanding of the manner in which the preferred embodiments of the invention achieve the foregoing objects will be enabled when the following detailed written description is considered in conjunction with the appended drawings in which.

Figure 1:
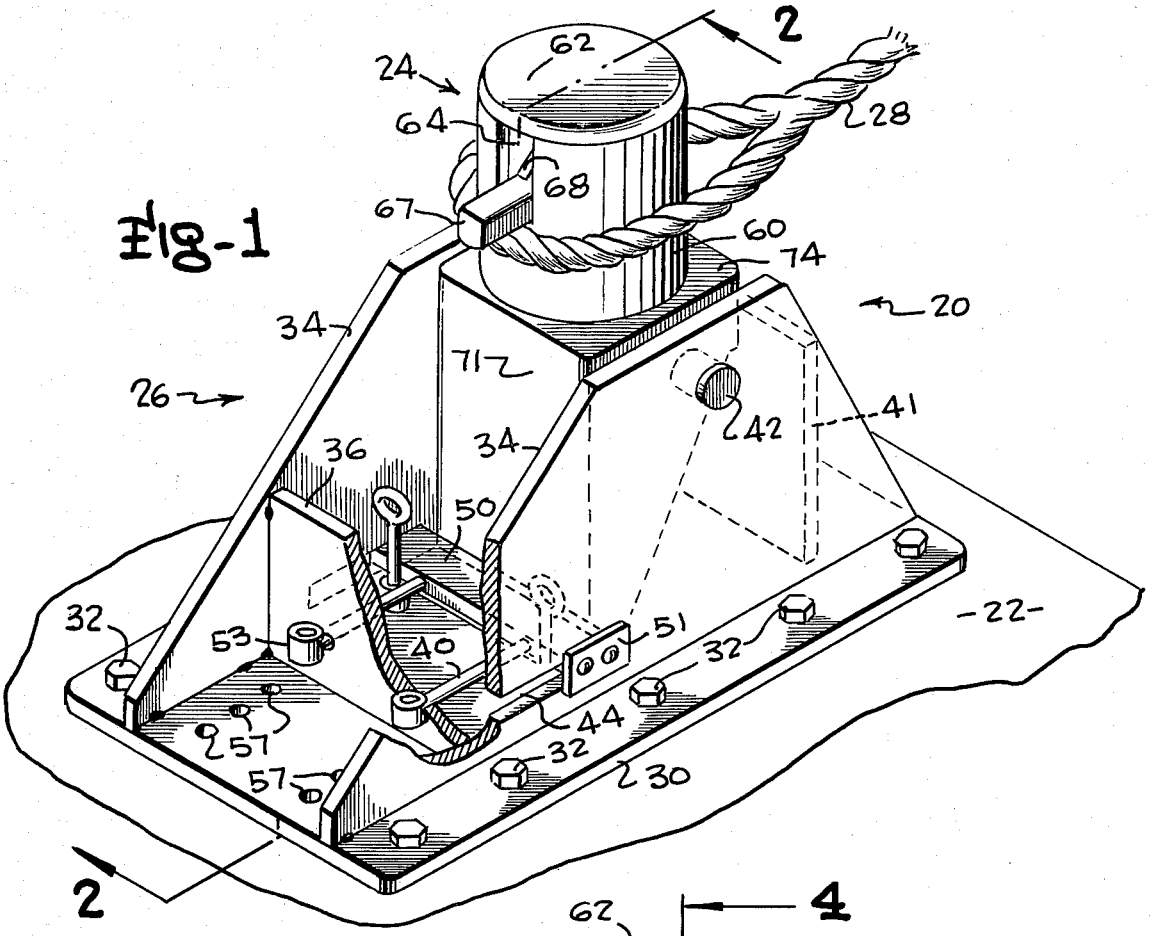
FIG. 1 is a perspective view of the first embodiment of the invention.

Attention is initially invited to FIG. 1 of the drawings which illustrates a first embodiment of the invention, generally designated 20, which is mounted on a supporting means having an upper surface 22 such as the deck of a vessel, barge or dock. The primary elements of the first embodiment comprise a pivotable bitt member 24 and a bitt base 26 which is fixedly attached to the supporting surface 22 and provides support for the bitt member 24. It should be noted at this juncture that the purpose of the device is to provide a strong and rigid bitt means to which a connecting cable 28 can be easily connected or disconnected as required.

Turning first to the structural details of the bitt base 26, it will be noted that a solid structural steel deck plate 30 forms the lower extent of the bitt base and is connected to the supporting surface 22 by bolts 32 in a manner that will be obvious to those of skill in the art. Additionally, it should be understood that the deck plate 30 can be welded or otherwise connected to the supporting surface 22, if required. In any event, first and second vertically extending side bracket plates 34 of identical construction extend upwardly from the deck plate 30 to which they are welded along the length of their lower edge surfaces.

A forward vertically extending brace plate 36 is welded on its end edges to the inwardly facing surfaces of the side bracket plates 34 and along its lower edge to the deck plate 30. Brace plate 36 includes a pair of spaced openings 38 through which lock bar actuator rods 40 extend for a purpose to be discussed hereinafter. A rearwardly vertically extending brace plate 41 is also welded between the side bracket plates 34 and to the deck panel 30 so as to provide great ruggedness and rigidity in the bitt base.

Figure 2:
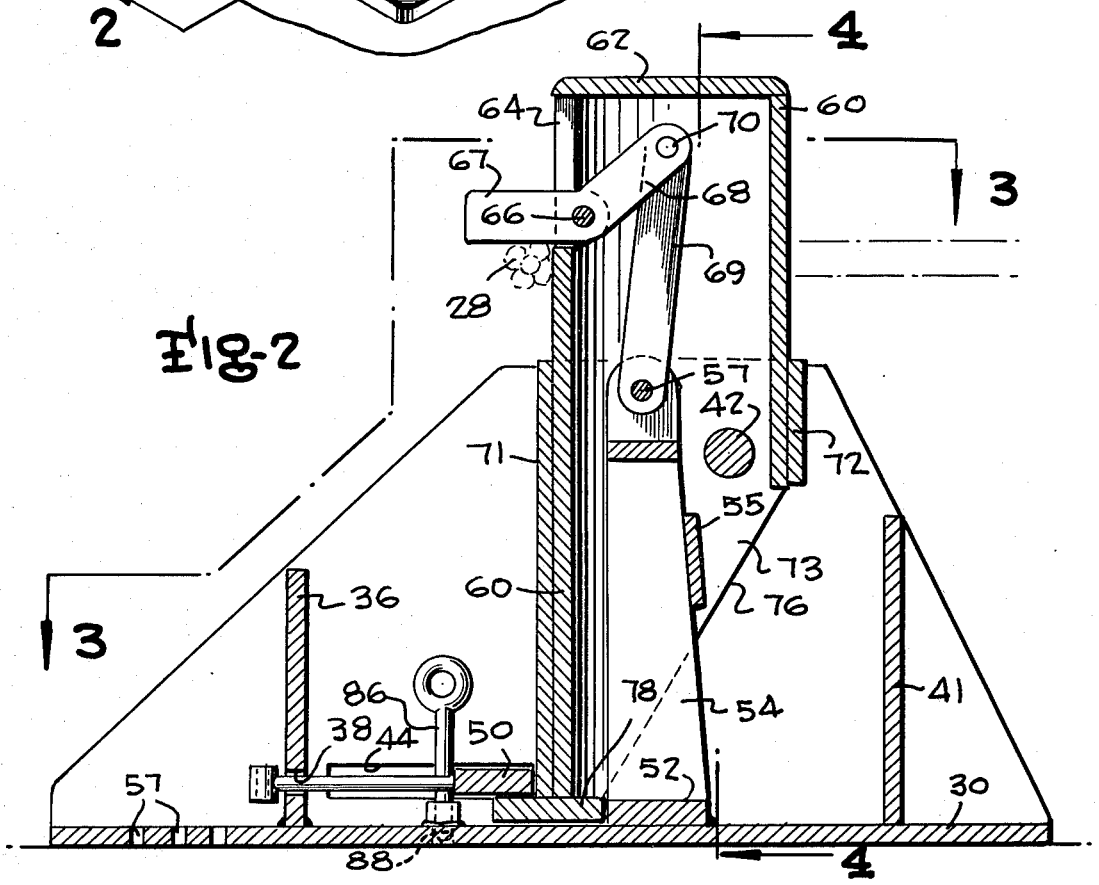
FIG. 2 is a sectional view taken along lines 2—2 of FIG. 1.
Figure 4:
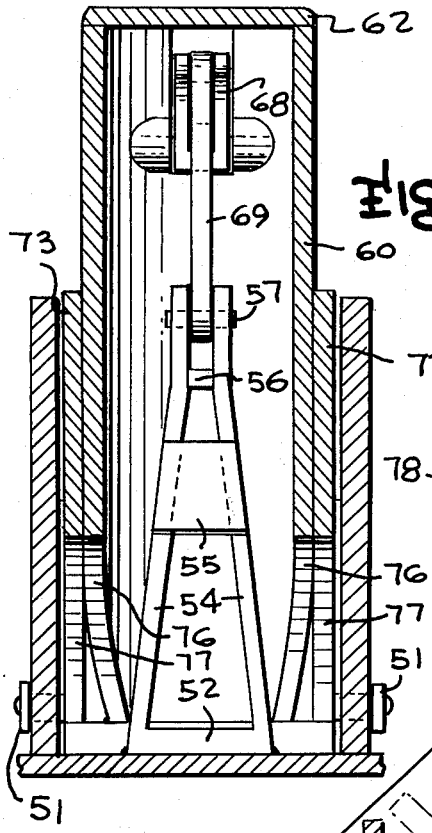
FIG. 4 is a sectional view taken along lines 4—4 of FIG. 2.

Additionally, the side bracket plates 34 are provided with aligned openings near their upper portions through which a large bitt pivot pin 42 extends. Similarly, horizontally extending aligned elongated lock bar slide slots 44 are provided in the side bracket plates 34 with a lock bar 50 having guide plates 51 attached to its ends and being mounted for reciprocation therein. The lock bar release rods 40 are connected to the lock bar 50 for enabling movement of the lock bar between a latching position in which it maintains the bitt in its vertical erect position and an unlatched position in which it permits the bitt to pivot about the large bitt pivot pin 42 to the position illustrated in FIG. 5. A stop plate 52, which is best illustrated in FIG. 2, is welded to the upper surface of the deck panel 30 for the purpose of limiting the extent of counter-clockwise movement of bitt member 24. Bitt base 26 also includes upwardly extending converging frame plates 54 which extend upwardly from the ends of the stop bar 52 and are braced by members 55, 56 to provide a rigid support for pivot pin 57 as best illustrated in FIG. 4.

Bitt member 24 includes a hollow cylindrical portion 60 having a top cap plate 62. An aperture 64 is provided in the cylindrical portion 60 and a chordal cross pin supporting pivot shaft 66 is positioned inwardly of the aperture as shown in FIG. 2. Pivot pin 66 provides a pivotal support for a cross pin 67 which has an inwardly extending bifurcated integral actuator arm 68 positioned on the interior of the cylindrical portion of the bitt member 24. An actuator link 69 is pivotally connected at 70 to the actuator arm 82 with the lower end of actuator link 69 being pivotally connected to the fixed pivot pin 57.

Bitt member 24 also includes a lower housing formed of a steel plate and including a front plate 71, a relatively short rear plate 72 and parallel side plates 73 and a horizontal cable support plate 74. The lower ends of the cylindrical portion 60 and parallel side plates 72 are cut along a diagonal plane to respectively define coplanar lower edges 76 and 77 as shown in FIG. 2. It should be understood that the cylindrical portion 60 is welded within the confines of the plates 71, 72 and 74. Lastly, a latch plate 78 is welded to the lower ends of the members 60, 71 as shown in FIG. 2 and is positioned so as to extend beneath the lock bar 50 when the lock bar is positioned in the locking position illustrated in FIG. 2.

Figure 5:
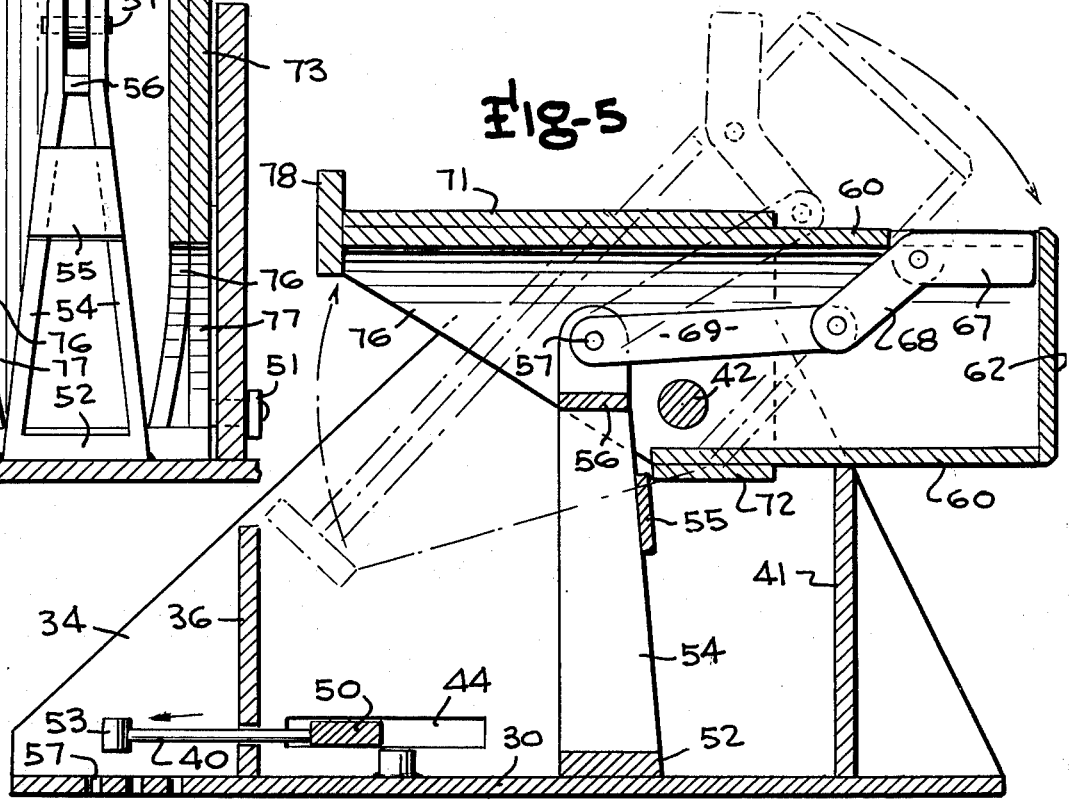
FIG. 5 is a sectional view similar to FIG. 2 but illustrating the bitt in a released position.

Bitt pivot pin 42 extends transversely across the width of the bitt member through the elements 73, 60 so that the bitt is capable of moving from a first or vertical position illustrated in FIGS. 1 and 2 to a second or horizontal position illustrated in FIG. 5. When the parts are in the vertical position illustrated in FIG. 2, the linkage means 68, 69 etc. positions the cross pin 67 to extend radially outwardly in a protruding manner as shown in FIG. 2 to retain the cable 28 in position so that it cannot slip above the upper end of the cylindrical portion 60 of the bitt member. However, bitt member 24 is capable of movement to a second or horizontal or release position as illustrated in FIG. 5 and such movement results in a pivoting of the cross pin 67 with respect to the cylindrical portion 60 about the pivot pin 66 so that the cross pin 67 moves from its extended position of FIG. 2 into a retracted position within the confines of the opening 64 as shown in FIG. 5. Consequently, movement of the bitt member from the first or vertical position of FIG. 2 to the second or horizontal release position of FIG. 5 serves to cause retraction of the cross pin 67 to permit the cable 28 to easily slip from over the cylindrical portion 60 to provide a complete release of the cable.

Figure 3:
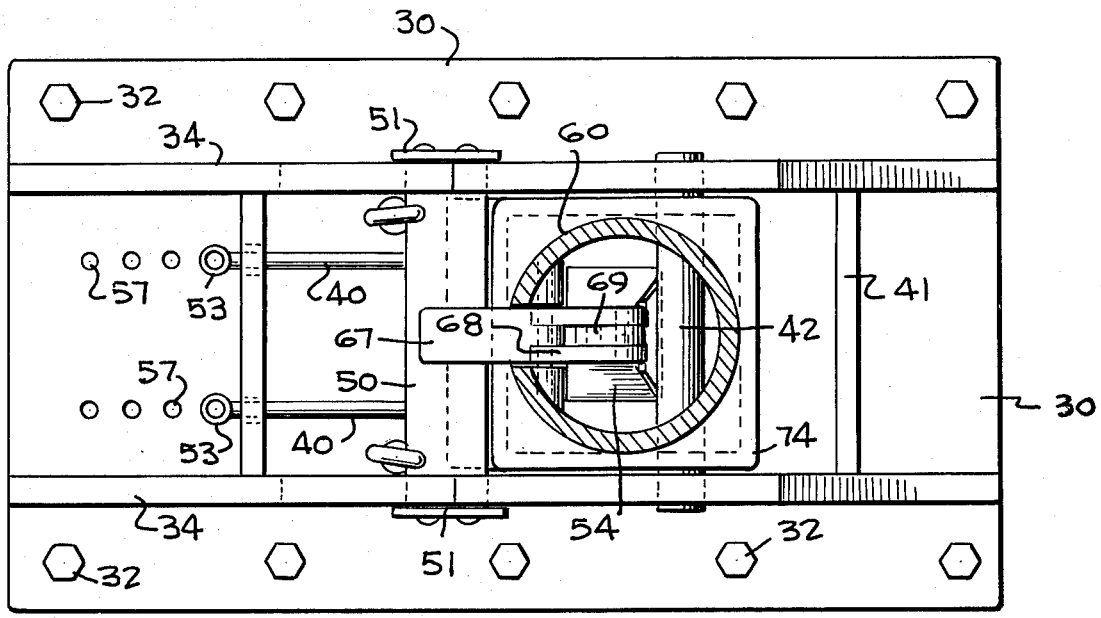
FIG. 3 is a sectional view taken along lines 3—3 of FIG. 2.

It is obviously necessary to maintain the member 24 in its vertical erect position of FIGS. 1 and 2 when the bitt is in use during a towing or mooring operation. Retention of the bitt member in its first or vertical position is enabled by moving the lock bar 50 to the extreme righthand end of slots 44 as viewed in FIG. 2 so that the lock bar overlies the latch plate 78. The lock bar is movable by virtue of movement of the lock bar actuator rods 40 connected to the lock bar. It will be observed that the ends of rods 40 include eyelet type members 53 having openings which move above pry holes 57 in the deck plate 30. A pry bar can be extended through the eyelets 53 to effect movement of the lock bar 50 either toward or away from the locking position. Safety lock pins 86 are positionable in openings 88 (FIG. 2) in the deck panel 30 for insuring that the lock bar 50 remains in the locked position illustrated in FIGS. 1 through 3.

During normal operation, the bitt 24 is maintained in the vertically extending erect position illustrated in FIGS. 1 and 2 with any force exerted on the bitt by cable 28 tending to press lock bar 50 upwardly against the top of slots 44 beyond which position the bar 50 obviously cannot move so that the bitt is effectively maintained in its vertical position; however, bitt 24 can be released for pivotal movement to the FIG. 5 position in the event of an emergency requiring release of the cable 28. Such pivotal movement is effected by initially removing the lock pins 86 and then subsequently moving lock bar actuator rods 40 from right to left as viewed in FIG. 2 so as to move the lock bar 50 from above the latch plate 78. Upon movement of the lock bar 50 to the position illustrated in FIG. 5, the bitt 24 can immediately pivot to its horizontal position illustrated in FIG. 5 with the movement also serving to retract the cross pin into the confines of the bitt.

Figure 6:
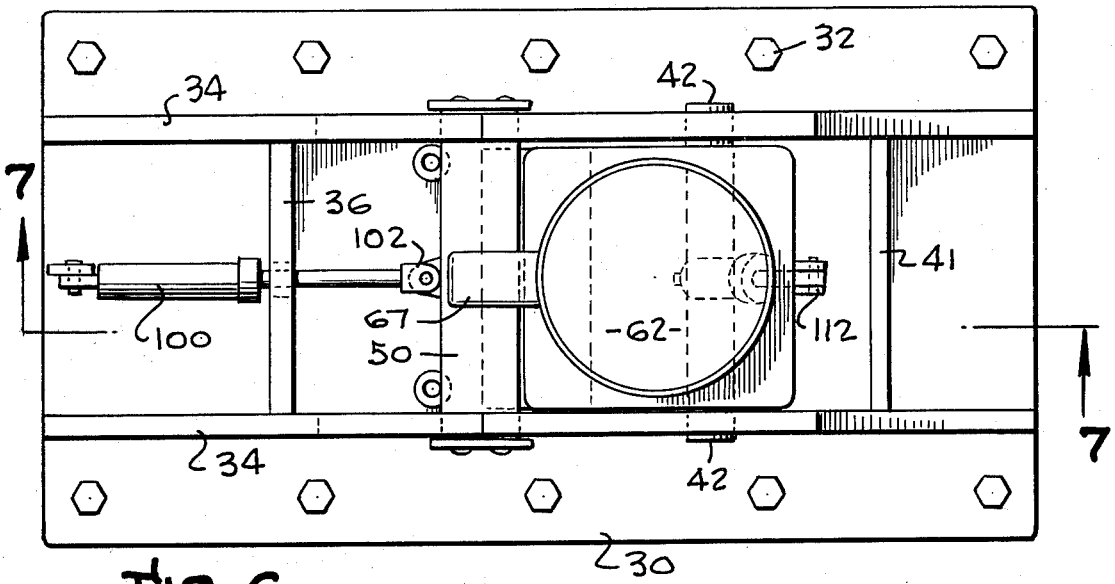
FIG. 6 is a top plan view of the second embodiment of the invention.
Figure 7:
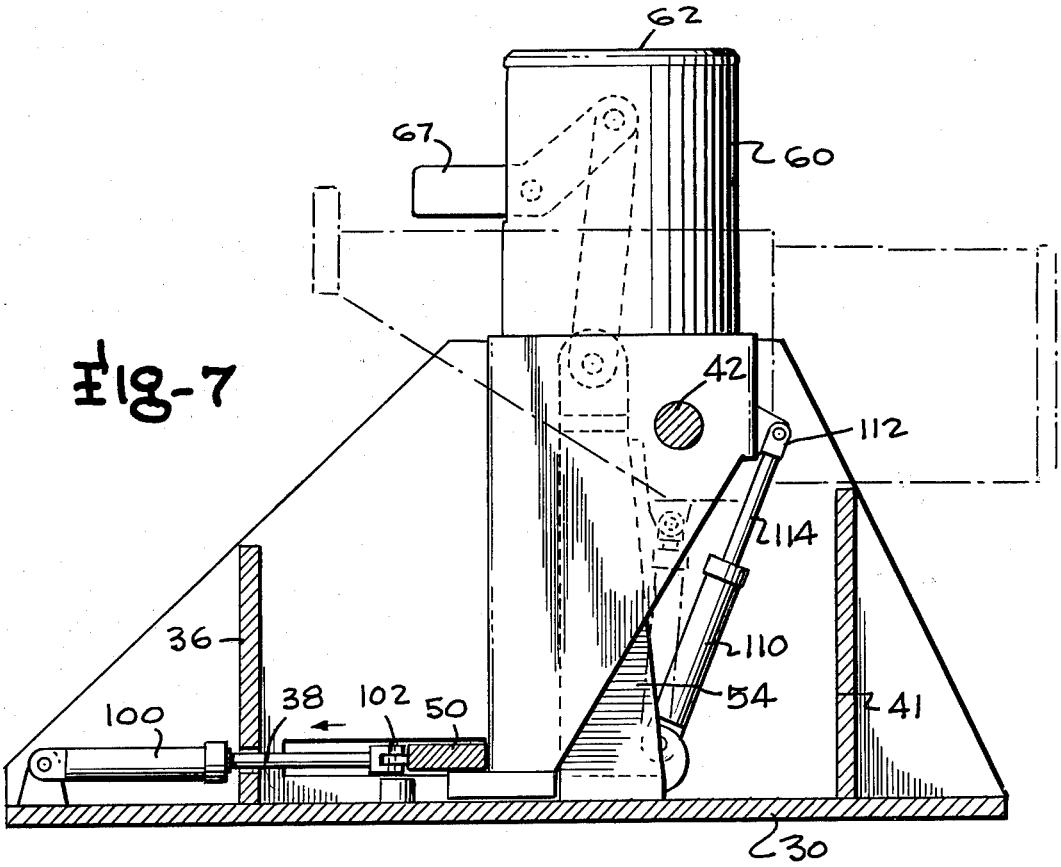
FIG. 7 is a sectional view taken along lines 7—7 of FIG. 6.

The embodiment of FIGS. 6 and 7 is identical to the embodiment of FIGS. 1 through 5 with the exception of the fact that a hydraulic piston and cylinder arrangement 100 is mounted on the deck plate 30 and has the end of its rod connected by a pin and clevis arrangement 102 to the lock bar 50. Consequently, operation of the cylinder 100 serves to move the lock bar 50 within the confines of the slide slots 44 between a locking position illustrated in FIG. 7 and a retracted or unlocking position identical to the position of the lock bar in FIG. 5. Additionally, the embodiments of FIGS. 6 and 7 differ from the first embodiment in that a second hydraulic piston and cylinder assembly 110 is connected between the deck plate 30 and the pivotal bitt member 24 by a pin and clevis arrangement 112 on the upper end of the rod 114 of the hydraulic assembly so that actuation of the hydraulic cylinder 100 serves to pivot the pivotal bitt member 24 between its first or erect position illustrated in solid lines in FIG. 7 and its second or horizontal release position illustrated in dashed lines in FIG. 7. In all other respects, the second embodiment is identical to the first embodiment and the same numerical designators have consequently been employed with the various parts of the second embodiment as are employed with the same parts in the first embodiment.

Numerous modifications of the preferred embodiments will undoubtedly occur to those of skill in the art and it should be understood that the spirit and scope of the invention is to be limited solely by the appended claims.

We claim:

1. A safety release bitt comprising a fixedly positioned bitt base, a bitt member, means supporting said bitt member on said bitt base for pivotal movement about a horizontal axis between a first position in which the bitt member is oriented with its axis extending in a vertical direction and a second position in which the bitt member is oriented with its axis extending in a horizontal direction, a cross pin mounted on an upper portion of said bitt member when said bitt member is in said first position, means supporting said cross pin for movement between an extended position in which the cross pin extends outwardly of said bitt member and a retracted position in which said cross pin is positioned inwardly of the outer surface of said bitt member and cross pin control means for automatically moving said cross pin from its extended position to its retracted position in response to movement of said bitt from its first position to its second position.

2. The invention of claim 1 additionally including latch means for retaining said bitt in its first position.

3. The invention of claim 2 wherein said means supporting said bitt for pivotal movement about said horizontal axis comprises a horizontally extending pivot pin extending through said bitt member and supported on opposite ends by said bitt base.

4. The invention of claim 1 additionally including latch plate means extending transveresely across a bottom portion of said bitt, a movable lock bar supported for reciprocation on said bitt base between a locking position in which said lock bar overlies said latch plate when said bitt is in its first position to prevent pivotal movement of said bitt from its fullest position toward its second position and a retracted position in which said lock bar is completely clear of said latch plate to permit said bitt to move from its first position to its second position.

5. The invention of claim 4 wherein said bitt base includes a deck plate and first and second parallel spaced side bracket plates, each of said parallel side bracket plates including a slide slot, said slide slot being aligned with each other and wherein said lock bar extends through said slide slot for reciprocation therein between its locking position and its retracted position.

6. The invention of claim 5 wherein said means supporting said bitt member on said bitt base for pivotal movement comprises a horizontal pivot pin extending between said side bracket plates in an upper portion thereof.

7. The invention of claim 6 additionally including hydraulic cylinder means for moving said lock bar between its locking and unlocking position.

8. The invention of claim 7 additionally including hydraulic cylinder means connected between said bitt base and said bitt member for pivoting said bitt member from its second position to its first position.

9. The invention of claim 1 wherein said means supporting said cross pin includes a pivot shaft mounted internally of said bitt member and said cross pin control means includes linkage means on the interior of said bitt member connecting said cross pin and said bitt base.

10. The invention of claim 9 wherein said means supporting said bitt for pivotal movement about said horizontal axis comprises a horizontally extending pivot pin extending through said bitt member and supported on opposite ends by said bitt base.

11. The invention of claim 9 additionally including latch plate means extending transversely across a bottom portion of said bitt, a movable lock bar supported for reciprocation on said bitt base between a locking position in which said lock bar overlies said latch plate when said bitt is in its first position to prevent pivotal movement of said bitt from its fullest position toward its second position and a retracted position in which said lock bar is completely clear of said latch plate to permit said bitt to move from its first position to its second position.

12. The invention of claim 11 wherein said bitt base includes a deck plate and first and second parallel spaced side bracket plates, each of said parallel side bracket plates including a slide slot, said slide slot being aligned with each other and wherein said lock bar extends through said slide slot for reciprocation therein between its locking position and its retracted position.

13. The invention of claim 12 additionally including hydraulic cylinder means for moving said lock bar between its locking and unlocking position.

14. The invention of claim 13 additionally including hydraulic cylinder means connected between said bitt base and said bitt member for pivoting said bitt member from its second position to its first position.

* * * * *

UNITED STATES PATENT AND TRADEMARK OFFICE

CERTIFICATE OF CORRECTION

PATENT NO. : 4,067,281

DATED : January 10, 1978

INVENTOR(S) : Arnold V. Walker and Harris H. Rose, Sr.

It is certified that error appears in the above-identified patent and that said Letters Patent are hereby corrected as shown below:

The drawing figure which appears on the cover sheet should be deleted and figure 1 of the drawings substituted therefor.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*